US009695681B2

(12) United States Patent
Portman

(10) Patent No.: US 9,695,681 B2
(45) Date of Patent: Jul. 4, 2017

(54) USE OF REAL-TIME PRESSURE DATA TO EVALUATE FRACTURING PERFORMANCE

(71) Applicant: BAKER HUGHES INCORPORATED, Houston, TX (US)

(72) Inventor: Lance Nigel Portman, The Woodlands, TX (US)

(73) Assignee: BAKER HUGHES INCORPORATED, Houston, TX (US)

( * ) Notice: Subject to any disclaimer, the term of this patent is extended or adjusted under 35 U.S.C. 154(b) by 308 days.

(21) Appl. No.: 14/529,550

(22) Filed: Oct. 31, 2014

(65) Prior Publication Data

US 2016/0123126 A1 May 5, 2016

(51) Int. Cl.

| | |
|---|---|
| ***E21B 43/26*** | (2006.01) |
| ***E21B 47/06*** | (2012.01) |
| ***E21B 33/124*** | (2006.01) |
| ***E21B 17/00*** | (2006.01) |

(52) U.S. Cl.
CPC ..... *E21B 43/26* (2013.01); *E21B 17/003* (2013.01); *E21B 33/124* (2013.01); *E21B 47/06* (2013.01)

(58) Field of Classification Search
CPC ..... E21B 43/26; E21B 43/162
USPC ..... 166/177.5, 269, 271, 308.1, 66
See application file for complete search history.

(56) References Cited

U.S. PATENT DOCUMENTS 7,152,700 B2 * 12/2006 Church ..... E21B 7/068 138/114
7,827,859 B2 * 11/2010 Pipchuk ..... E21B 33/124 73/152.18
8,210,257 B2 * 7/2012 Dusterhoft ..... E21B 43/26 166/250.1
8,490,704 B2 * 7/2013 Caro ..... E21B 33/124 166/177.5
8,714,244 B2 * 5/2014 Conkle ..... E21B 43/26 166/250.1
9,140,102 B2 * 9/2015 Bartko ..... E21B 43/26
(Continued)

FOREIGN PATENT DOCUMENTS

WO WO2013085479 6/2013

OTHER PUBLICATIONS

Korean Intellectual Property Office; International Searching Authority; International Search Report and Written Opinion for Application No. PCT/US2015/057578 dated Jan. 7, 2016.

*Primary Examiner* — Kenneth L Thompson
(74) *Attorney, Agent, or Firm* — Parsons Behle & Latimer

(57) ABSTRACT

A method of fracturing a wellbore formation that includes positioning an end of a coiled tubing string adjacent a first location within a wellbore, pumping fluid down the wellbore to fracture the formation, and monitoring a pressure within the wellbore during the procedure with at least one sensor connected to a communication line. The fracturing procedure may be a re-fracturing of the wellbore. The method may include actuating a single isolation element or two isolation elements to isolate a portion of the wellbore to be fractured. The method may include modifying the fracturing procedure in real time based on data from monitoring the pressure during the procedure. A system for fracturing a wellbore includes coiled tubing, a communication line within the coiled tubing, and at least one pressure sensor connected to the communication line. Pressure sensors may be connected to both the exterior and interior of the coiled tubing.

16 Claims, 6 Drawing Sheets

(56) References Cited

U.S. PATENT DOCUMENTS

| | | | | |
|---|---|---|---|---|
| 2002/0007945 | A1* | 1/2002 | Neuroth | E21B 17/20 166/66 |
| 2006/0102342 | A1 | 5/2006 | East et al. | |
| 2010/0314106 | A1* | 12/2010 | Tubel | E21B 17/20 166/250.1 |
| 2011/0284214 | A1* | 11/2011 | Ayoub | E21B 43/26 166/177.5 |
| 2012/0043077 | A1 | 2/2012 | Edwards | |
| 2013/0087321 | A1 | 4/2013 | Bartko et al. | |
| 2014/0262232 | A1 | 9/2014 | Dusterhoft et al. | |
| 2015/0075787 | A1* | 3/2015 | Davidson | E21B 49/008 166/254.1 |
| 2015/0369023 | A1* | 12/2015 | MacPhail | E21B 43/12 166/269 |
| 2016/0053597 | A1* | 2/2016 | Brown | E21B 43/26 166/250.1 |
| 2016/0084056 | A1* | 3/2016 | Flores | E21B 43/26 166/250.01 |
| 2016/0084078 | A1* | 3/2016 | Flores | E21B 49/008 166/250.1 |

* cited by examiner

USE OF REAL-TIME PRESSURE DATA TO EVALUATE FRACTURING PERFORMANCE

FIELD OF THE DISCLOSURE

The embodiments described herein relate to a system and method that provides real time downhole pressure readings during a fracturing, or re-fracturing, procedure that may permit the optimization of the procedure.

BACKGROUND

Description of the Related Art

Natural resources such as gas and oil may be recovered from subterranean formations using well-known techniques. Wellbores, both vertical and horizontal, may be drilled into a formation. After formation of the wellbore, a string of pipe, e.g., casing, may be run or cemented into the wellbore. Hydrocarbons may then be produced from the wellbore.

In an attempt to increase the production of hydrocarbons from the wellbore, the casing is often perforated and fracturing fluid is pumped into the wellbore to fracture the subterranean formation. Hydraulic fracturing of a wellbore has been used for more than 60 years to increase the flow capacity of hydrocarbons from a wellbore. Hydraulic fracturing pumps fluids into the wellbore at high pressures and pumping rates so that the rock formation of the wellbore fails and forms a fracture to increase the hydrocarbon production from the formation by providing additional pathways through which reservoir fluids being produced can flow into the wellbore. Pressures are known at the surface during the fracturing procedure, but often wellbore conditions between the surface and location being fractured may make it difficult, if not impossible, to predict the actual pressure of the fracturing fluid as it impacts the formation. Further, it may not be determined whether the hydraulic fracturing was effective until after completion of the fracturing procedure and the well begins to produce hydrocarbons from the recently fractured location.

A production zone within a wellbore may have been previously fractured, but the prior hydraulic fracturing treatment may not have adequately stimulated the formation leading to insufficient production results. Even if the formation was adequately fractured, the production zone may no longer be producing at desired levels. Over an extended period of time, the production from a previously fractured wellbore may decrease below a minimum threshold level. The wellbore may be re-fractured in an attempt to increase the hydrocarbon production. Again, the effectiveness of a re-fracturing procedure may not be known until the re-fracturing procedure has been completed. If not effective, a subsequent procedure costing time and money may need to be done. It may be beneficial to provide a system and method for the real time monitoring of fracturing and re-fracturing procedures.

SUMMARY

The present disclosure is directed to system and method for providing real time pressure readings during a fracturing, or re-fracturing, procedure that overcomes some of the problems and disadvantages discussed above.

One embodiment is a method of fracturing a wellbore formation comprising positioning an end of a coiled tubing string adjacent a first location within a wellbore, the tubing string extending from a surface location to the first location.

The method comprises pumping fluid down the wellbore to perform a fracturing procedure to fracture a wellbore formation adjacent the first location. The method comprises monitoring a pressure within the wellbore adjacent to the first location during the fracturing of the wellbore formation with at least one sensor connected to the surface via a communication line positioned within an interior of the coiled tubing string.

The method may include modifying the fracturing procedure substantially simultaneous with the fracturing procedure based on monitoring the pressure within the wellbore. Modifying the fracturing procedure may comprise changing a pressure of the fluid being pumped down the wellbore or changing a composition of the fluid being pumped down the wellbore. Changing the pressure of the fluid being pumped down the wellbore may comprise changing a pumping rate of the fluid being pumped down the wellbore. The fracturing procedure may be a re-fracturing procedure with the wellbore formation adjacent the first location having been previously hydraulically fractured.

The method may include actuating an isolation element connected to the coiled tubing below the first location prior to pumping fluid down the wellbore. Monitoring the pressure may include monitoring the pressure with a first sensor connected to an exterior of the coiled tubing string below the isolation element, monitoring the pressure with a second sensor connected to the exterior of the coiled tubing string above the isolation element, and monitoring the pressure within a third sensor connected to the interior of the coiled tubing string, wherein the first, second, and third sensors are connected to the communication line. Pumping fluid down the wellbore may comprise pumping fluid down an annulus between the exterior of the coiled tubing string and the wellbore. Pumping fluid down the wellbore may comprise pumping the fluid down the interior of the coiled tubing string. Pumping fluid down the wellbore may comprise pumping the fluid down the interior of the coiled tubing string and pumping the fluid down an annulus between the exterior of the coiled tubing string and the wellbore.

Monitoring the pressure may comprise monitoring the pressure with a first sensor connected to an exterior of the coiled tubing string and monitoring the pressure with a second sensor connected to the interior of the coiled tubing string, wherein the first and second sensors are connected to the communication line. The method may include actuating a first isolation element connect to the coiled tubing string below the first location and actuating a second isolation element connected to the coiled tubing string above the first location, the first and second isolation elements being actuated prior to pumping fluid down the wellbore. Pumping fluid down the wellbore may comprise pumping the fluid down the interior of the coiled tubing string and out a port between the first and second isolation elements. Monitoring the pressure may comprise monitoring the pressure with a first sensor connected to an exterior of the coiled tubing string below the first isolation element, monitoring the pressure with a second sensor connected to the exterior of the coiled tubing string between the first and second isolation elements, monitoring the pressure with a third sensor connected to the exterior of the coiled tubing string above the second isolation element, and monitoring the pressure with a fourth sensor connected to the interior of the coiled tubing string, wherein the first, second, third, and fourth sensor are connected to the communication line.

The method may comprise actuating an isolation element prior to pumping the fluid down the wellbore, the isolation element may be connected to the coiled tubing string and be positioned above the first location, and wherein pumping fluid down the wellbore may comprise pumping fluid down the interior of the coiled tubing string. Monitoring the pressure may comprise monitoring the pressure with a first sensor connected to an exterior of the coiled tubing string below the isolation element, monitoring the pressure with a second sensor connected to the exterior of the coiled tubing string above the isolation element, and monitoring the pressure with a third sensor connected to the interior of the coiled tubing string, wherein the first, second, and third sensors are connected to the communication line. The method may include providing diverting material within the wellbore below the first location to isolate a portion of the wellbore below the first location, wherein the diverting material is provided prior to pumping fluid down the wellbore to perform the fracturing procedure.

One embodiment is a system for fracturing a multizone wellbore comprising a coiled tubing string positioned within a multizone wellbore, the tubing string extends from a surface location with an end being positioned adjacent a first location in the multizone wellbore. The system comprising a communication line within an interior of the coiled tubing string and at least one pressure sensor connected to the communication line. The communication line may be an electrical line or a fiber optic line.

The system may comprise a first pressure sensor connected to an exterior of the coiled tubing string and a second pressure sensor connected to the interior of the coiled tubing string. The system may comprise a first isolation element connected to the coiled tubing string and a third pressure sensor connected to the exterior of the coiled tubing string, wherein the first pressure sensor is positioned below the first isolation element and the third pressure sensor is positioned above the first isolation element. The first isolation element may be positioned below a wellbore location to be fractured. The system may comprise a second isolation element connected to the coiled tubing string, a port in the coiled tubing string between the first and second isolation elements, and a fourth pressure sensor connected to the exterior of the coiled tubing string, wherein the third pressure sensor is positioned below the second isolation element and the fourth pressure sensor is positioned above the second isolation element. The communication line and the at least one pressure sensor may provide substantially real time monitoring of pressure during a fracturing procedure.

Figure 1:
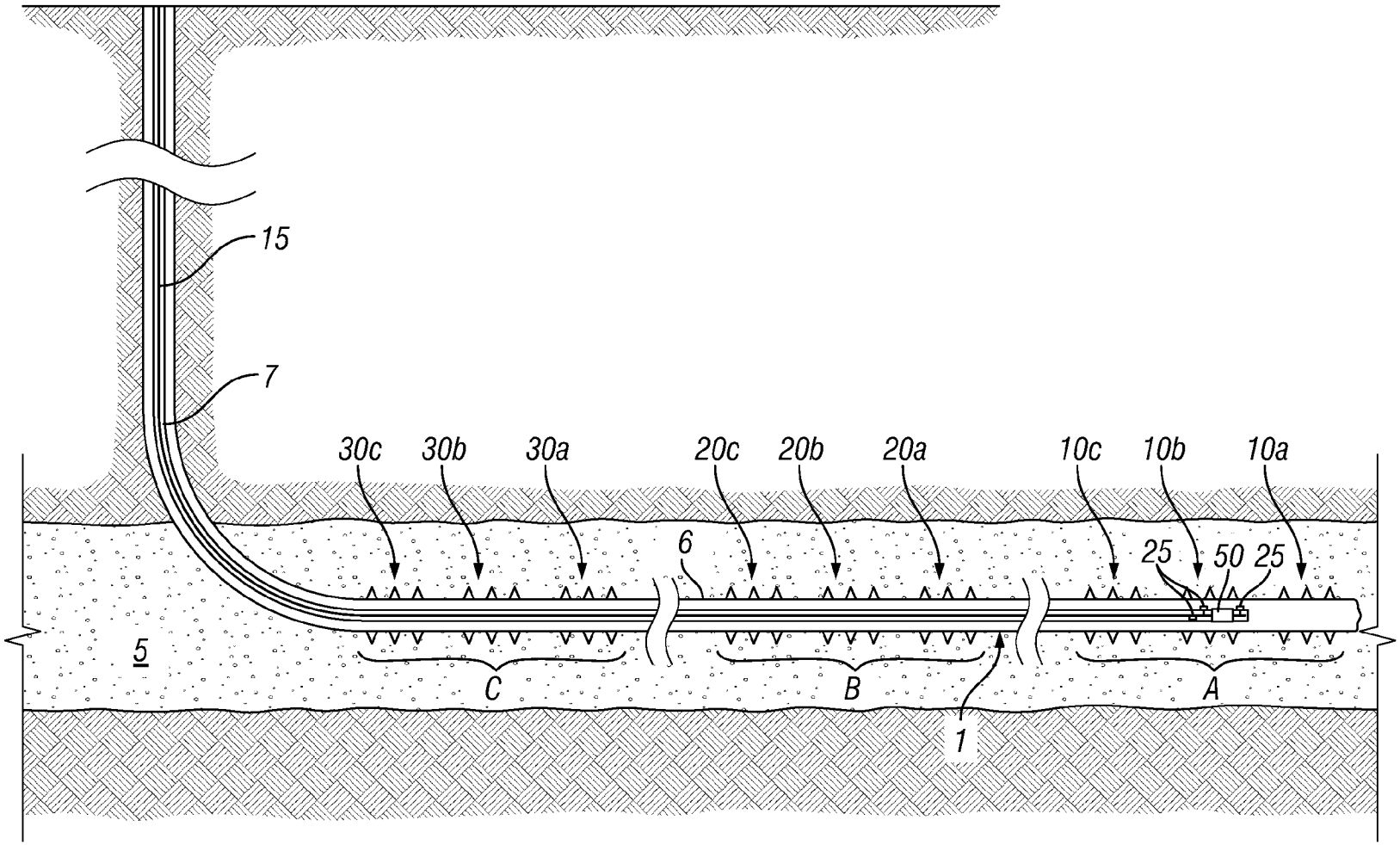
FIG. 1 shows one embodiment of coiled tubing positioned within a horizontal wellbore having a plurality of locations that have been previously fractured.

While the disclosure is susceptible to various modifications and alternative forms, specific embodiments have been shown by way of example in the drawings and will be described in detail herein. However, it should be understood that the disclosure is not intended to be limited to the particular forms disclosed. Rather, the intention is to cover all modifications, equivalents and alternatives falling within the scope of the invention as defined by the appended claims.

DETAILED DESCRIPTION

FIG. 1 shows a schematic of a multizone horizontal wellbore 1 within a well formation 5. The horizontal wellbore 1 includes a plurality of zones A, B, and C that each may contain a plurality of locations 10*a*, 10*b*, 10*c*, 20*a*, 20*b*, 20*c*, 30*a*, 30*b*, and 30*c* that have been previously fractured. The locations 10*a*, 10*b*, 10*c*, 20*a*, 20*b*, 20*c*, 30*a*, 30*b*, and 30*c* may be prior fractures, fracture clusters, or perforations within a casing. As discussed herein, each location may include one or more fracture clusters that have been previously fractured or were attempted to be previously fractured. Although the FIG. 1-3 only show a multizone horizontal wellbore with cemented casing, the location may also be a fracture port in a ported completion that has been left open after a prior fracturing operation in an attempt to fracture the formation behind the fracture port. For example, the system and method disclosed herein may be used to re-fracture the formation 5 through the ported completion disclosed in U.S. patent application Ser. No. 12/842,099 entitled "Bottom Hole Assembly With Ported Completion and Methods of Fracturing Therewith," filed on Jul. 23, 2010, by John Edward Ravensbergen and Lyle E. Laun, which is incorporated by reference herein in its entirety.

For illustrative purposes only, FIG. 1 shows three zones or segments of the multizone horizontal wellbore 1. Likewise, FIG. 1 shows three previously fractured locations per zone or segment, for illustrative purposes only. A multizone horizontal wellbore 1 may include a various number of zones or segments such as A, B, and C that have been previously fractured, as would be appreciated by one of ordinary skill in the art having the benefit of this disclosure. Likewise, the number of previously fractured locations within each zone or segment may vary. As discussed above, the previously hydraulically fractured locations may comprise a perforation through casing that was attempted to be fractured, a fracture or fracture cluster in the formation, or a fracture port in a completion. A previously fractured location includes any location within a wellbore that has been previously subjected to a fracturing treatment, in an attempt to fracture the formation at that location, whether or not the formation actually fractured. Hereinafter, the previously fractured locations will be referred to as a fracture cluster, but such locations should not be limited to those previously fractured locations that resulted in a fracture cluster and may include any of the above noted, or other fracture locations.

A production zone may have as few as a single fracture cluster or may include more than ten (10) fracture clusters. The multiple zones of a multizone horizontal wellbore 1 may include a plurality of fracture clusters 10, 20, and 30 that extend into the formation 5 that surrounds the casing 6 of the multizone horizontal wellbore 1. As discussed above, the formation 5 is fractured by a plurality of fracture clusters 10, 20, and 30 to increase the production of hydrocarbons from the wellbore. When the rate of production from the horizontal wellbore decreases below a minimum threshold value it may be necessary to re-fracture selected fracture clusters 10, 20, and 30 within the wellbore 1.

A coiled tubing string 7 may be positioned within the casing 6 of the horizontal wellbore 1 having a packer or sealing element 50, hereinafter referred to as an isolation element. The isolation element 50 may be actuated to create a seal in the annulus between the coiled tubing 7 and the casing 6. The coiled tubing 7 includes an electrical or fiber optic line 15, also referred to as a communication line or e-line, within the interior of the coiled tubing 7. Although shown in a horizontal wellbore 1, the coiled tubing 7 with an electrical line 15 may also be used in a vertical wellbore as would be appreciated by one of ordinary skill in the art having the benefit of this disclosure. The e-line 15 extends from the surface to the end or near the end of the coiled tubing 7. The e-line 15 is connected to one or more pressure sensors 25 connected to the coiled tubing 7. The e-line 15 is connected to a first pressure sensor 25 connected to the exterior of the coiled tubing 7 below the isolation element 50 and a second pressure sensor 25 connected to the exterior of the coiled tubing 7 above the isolation element 50. The first and second pressure sensors 25 may be used to monitor the annulus pressure above and below isolation element 50 via the e-line 15. The e-line 15 is connected to a third pressure sensor 25 positioned to monitor the pressure within the interior of the coiled tubing 7. The location and number of the pressure sensors 25 may be varied depending on the application as detailed herein and would be appreciated by one of ordinary skill in the art having the benefit of this disclosure.

Figure 2:
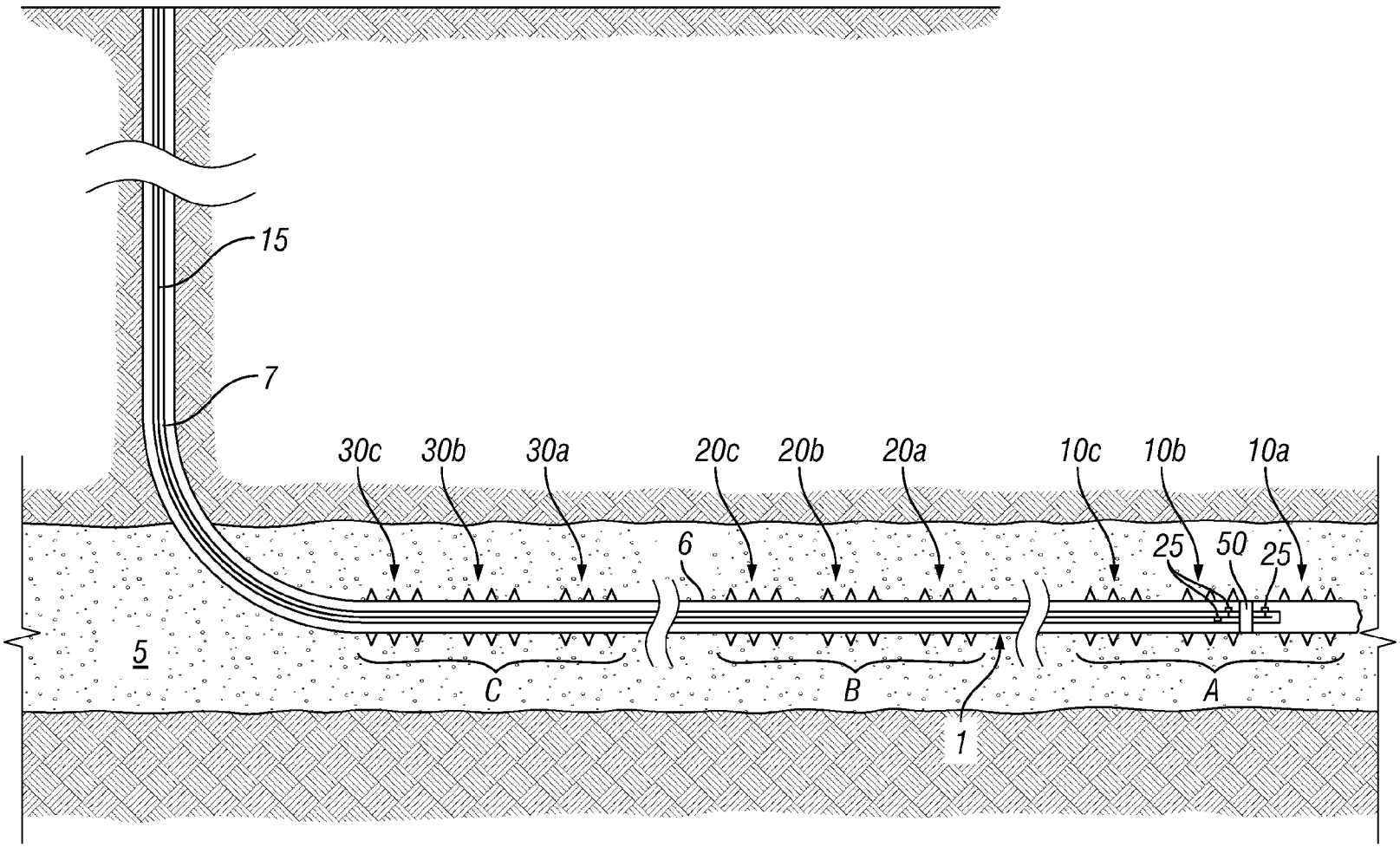
FIG. 2 shows one embodiment of coiled tubing positioned within a horizontal wellbore having a plurality of locations that have been previously fractured with an isolation element actuated to isolate a portion of the wellbore.

The isolation element 50 may be positioned uphole of the lowermost fracture cluster 10*a* and actuated to create a seal between the coiled tubing 7 and the casing 6 of the horizontal wellbore 1. FIG. 2 shows the isolation element 50 actuated to hydraulically isolate the lowermost fracture cluster 10*a* from the portion of the horizontal wellbore 1 located above the actuated isolation element 50. Various packers and/or sealing elements may be used to in connection with the coiled tubing 7 to hydraulically isolate the fracture cluster 10*a* as would be appreciated by one of ordinary skill in the art having the benefit of this disclosure. The first, second, and third pressure sensors 25 may be monitored to determine various characteristics of the coiled tubing 7, isolation element 50, and the formation 5. For example, the first and second pressure sensors 25 may help an operator determine that there is a leak or problem in the integrity of the isolation element 50 when actuated against the casing 6. The isolation element 50 includes a sealing element that may be repeatedly actuated and/or energized to create a seal between the coiled tubing 7 and the wellbore casing 6.

Figure 3:
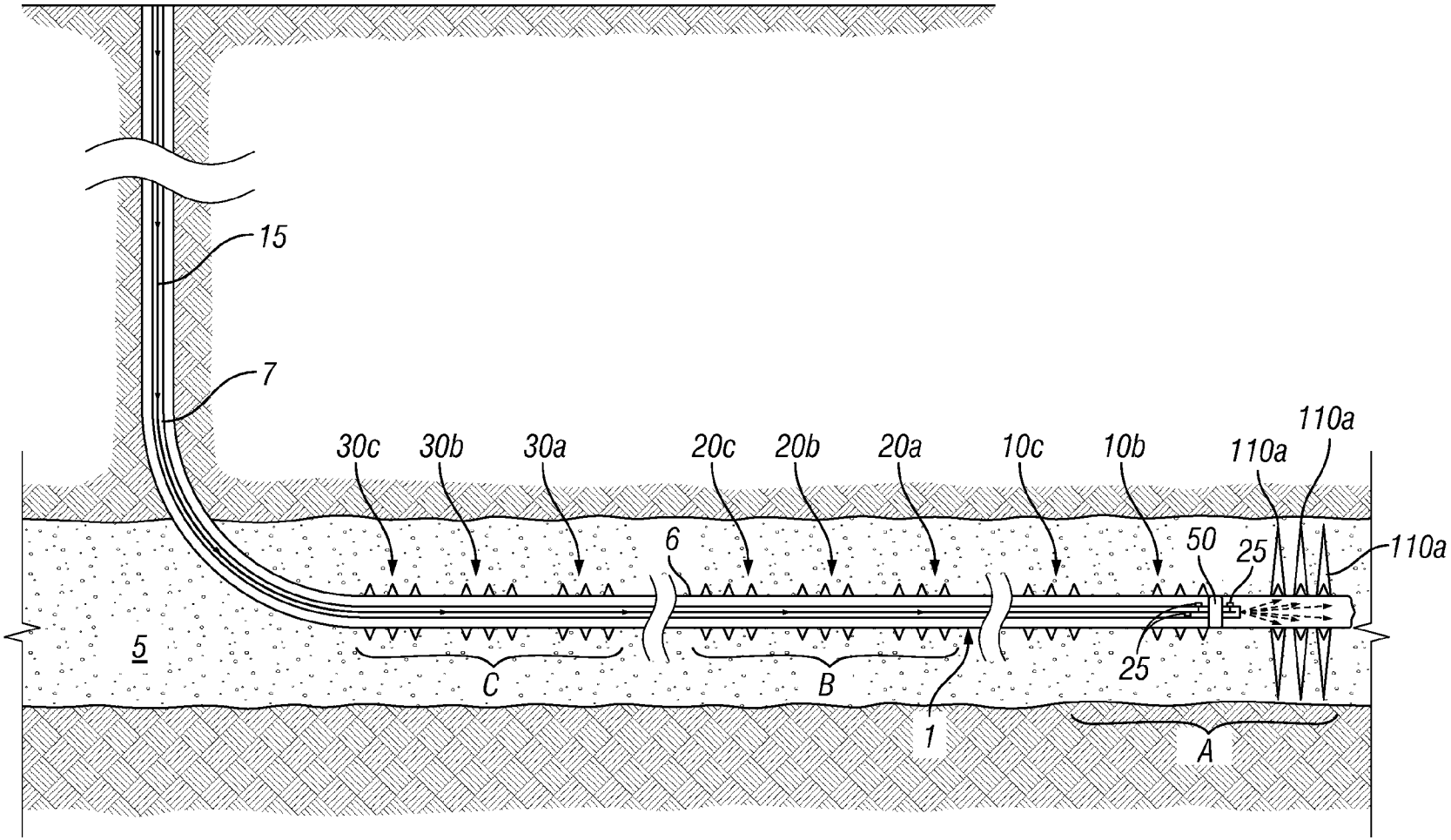
FIG. 3 shows one embodiment of coiled tubing positioned within a horizontal wellbore during the re-fracturing of a previously fractured location of the wellbore.

FIG. 3 shows that fluid is pumped down the coiled tubing 7 and out of the end to hydraulically re-fracture cluster 110*a*, which was previously fractured fracture cluster 10*a* (shown in FIG. 1-2). The first, second, and third pressure sensors 25 may be used to monitor the pressure in the coiled tubing 7, in the annulus above the isolation element 50, and below the isolation element 50. The pressure readings may be transmitted to the surface via e-line 15, which permits the real time monitoring of the fracture, or in this case, the re-fracturing procedure of the wellbore formation 5. The monitoring of the pressure via the sensors 25 permits the operator to adjust the fracturing process in real time (i.e., as it takes place), or approximate real time, to optimize the procedure. For example, the pressure readings may indicate that the pressure of the fracturing fluid at the surface may need to be increased or decreased so that the pressure realized at the fracturing location is at a desired pressure. Further, the pressure readings may provide information to the operator that necessitates the modification of the fracturing fluid being pumped down the coiled tubing at the surface.

Figure 4:
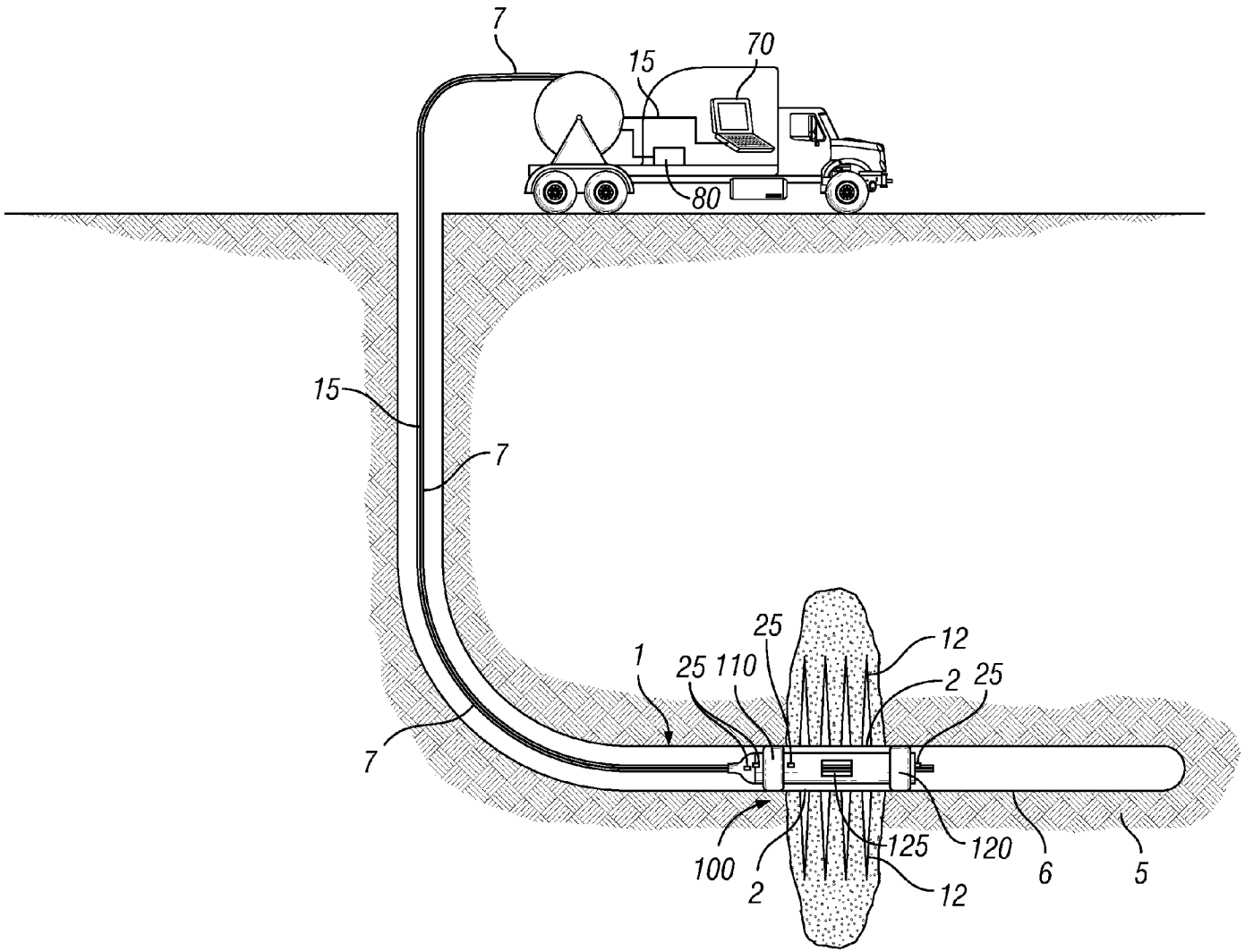
FIG. 4 shows one embodiment of coiled tubing having two isolation elements positioned within a horizontal wellbore.

FIG. 4 shows coiled tubing 7 having an e-line 15 connected to a first isolation element 110 and a second isolation element 120 within a horizontal wellbore 1. Although the coiled tubing 7 is shown in a horizontal wellbore 1, the coiled tubing 1 having a communication line 15 and first and second isolation elements 110 and 120 may also be used in a vertical wellbore as would be appreciated by one of ordinary skill in the art. The first and second isolation elements 110 and 120 may be actuated to isolate a portion of the wellbore 1. Fluid may be pumped down the coiled tubing 7 and out a port 125 between the isolation elements 110 and 120 to fracture, or re-fracture, the formation 5 traversed by the wellbore 1 as shown in FIG. 4. The coiled tubing 7 may be connected to a downhole tool configured to repeatedly set and unset two isolation elements such as a tool disclosed in U.S. patent application Ser. No. 14/318,952 entitled "Synchronic Dual Packer" filed on Jun. 30, 2014, which is incorporated by reference in its entirety.

The communication line 15 is connected to a first pressure sensor 25 connected to the exterior of the coiled tubing 7 below the second isolation element 120, is connected to a second pressure sensor 25 connected to the exterior of the coiled tubing 7 between the first and second isolation elements 110 and 120, is connected to a third pressure sensor 25 connected to the exterior of the coiled tubing string above the first isolation element 110, and is connected to a fourth pressure sensor 25 connected to the interior of the coiled tubing 7. The coiled tubing is connected to a pump 8 that may be used to pump fluid down the coiled tubing 7 to fracture 12, or re-fracture, the formation 5 through perforations 2 in the casing 6. The communication line 15 may be connected to a processing device 70 used to analyze the data from each of the pressure sensors 25 connected to the communication line 15. The processing device 70 may determine how to optimize the fracturing, or re-fracturing, procedure in real time, or near real time, via the data received from the pressure sensors 25 via the communication line 15 during the fracture, or re-fracturing, procedure.

Figure 5:
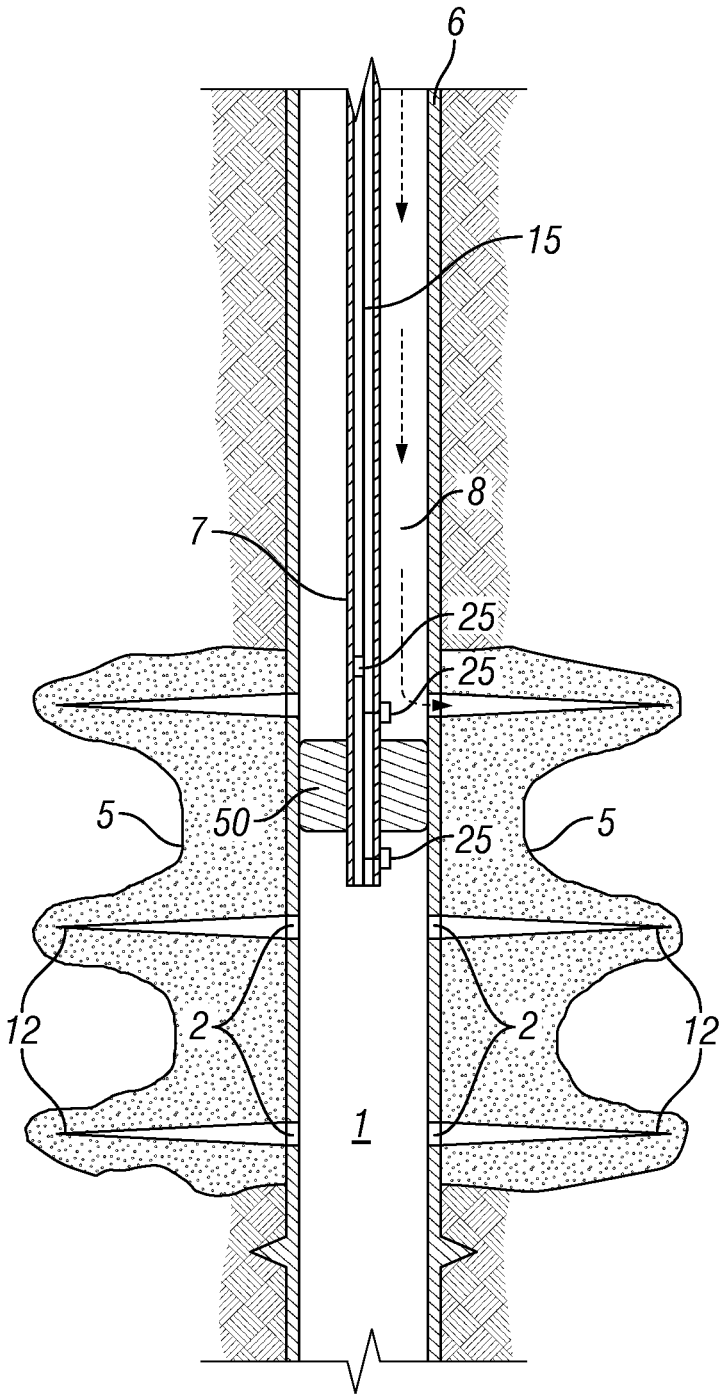
FIG. 5 shows one embodiment of coiled tubing positioned within a wellbore during a fracturing procedure.

FIG. 5 shows a portion of coiled tubing 7 within a wellbore 1. An e-line 15 is positioned within the coiled tubing 7 and is connected to first and second pressure sensors 25 connected to the exterior of the coiled tubing 7. The e-line 15 is also connected to a third sensor 25 positioned to monitor the pressure within the coiled tubing 7. An isolation element 50 has been actuated to isolate two prior fractures 12 in the formation 5. Fluid is pumped down the annulus 8 between the coiled tubing 7 and the casing 6 of the wellbore 1, as indicated by the arrows in the annulus 8, to fracture 12 the formation 5 through a perforation 2 in the casing 6. The plurality of sensors 25 connected to the e-line 15 are used to monitor the pressure within the coiled tubing 7, in the annulus above the isolation element 50 and below the isolation element 50. The e-line 15 in communication with the sensors 25 provides for the real time monitoring of the fracturing procedure, which permits the modification of the procedure to potentially optimize the fracturing of the wellbore formation 5.

Figure 6:
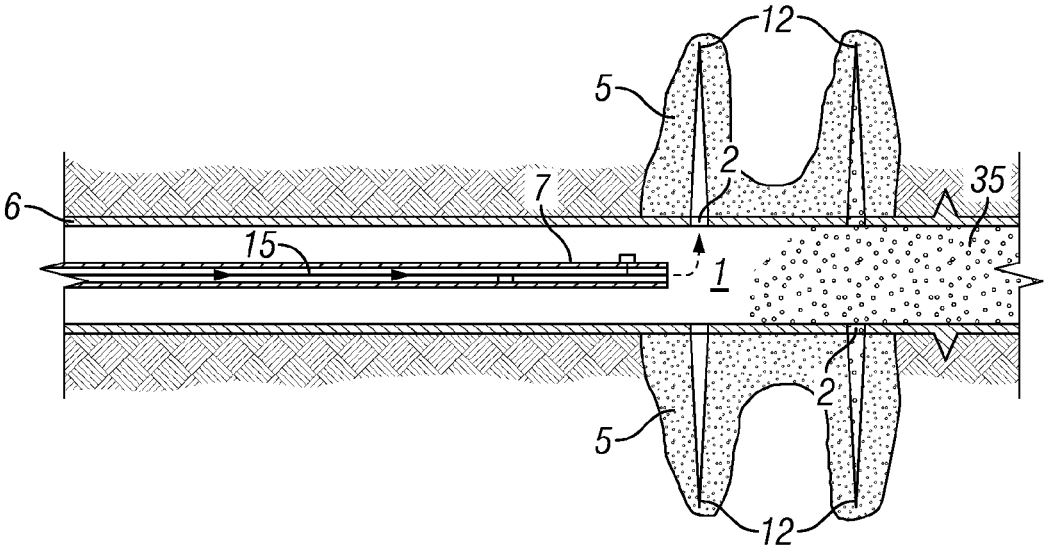
FIG. 6 shows one embodiment of coiled tubing positioned within a horizontal wellbore during a fracturing procedure.

FIG. 6 shows a portion of coiled tubing 7 within a portion of a wellbore 1. An e-line 15 within the coiled tubing 7 permits communication with sensors 25 during a fracturing procedure using the coiled tubing 7. One sensor 25 is connected to the exterior of the coiled tubing 7 and one sensor 25 is positioned within the interior of the coiled tubing 7. Fluid is pumped down the coiled tubing 7 to fracture 12 the formation 5 adjacent a perforation 2 in the casing 6 of the wellbore 1. Diverting material, such as a sand plug 35, may be used to hydraulically isolate a previous fracture 12 in the formation 5 and divert the fluid pumped down the coiled tubing 7 to create a fracture 12 at the desired location.

Figure 7:
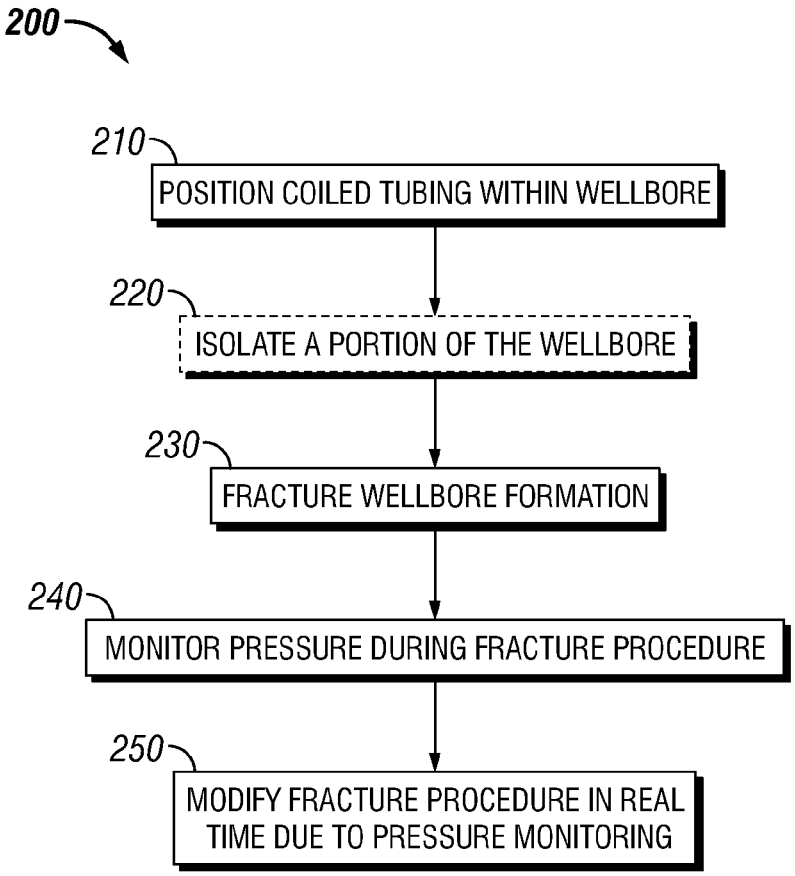
FIG. 7 shows a flow chart of one embodiment of a method of fracturing a wellbore formation.

FIG. 7 shows one embodiment of a method 200 of fracturing a wellbore. The wellbore may be a vertical wellbore or a horizontal wellbore. In step 210, coiled tubing 7 is positioned within the wellbore 1. The coiled tubing 7 may include an isolation element 50 or isolation elements 110 and 120 that may be used to selectively isolation a portion of the wellbore. In optional step 220, a portion of the wellbore is isolated by the isolation element(s). The wellbore formation is fractured, or re-fractured, in step 230. During the fracturing procedure, the pressure is monitored via one or more pressure sensors 25 connected to a communication line 15 that runs through the coiled tubing 7 in step 240. The data from the pressure sensors 25 is provided in real time, or near real time, and in step 250, the fracturing procedure is modified, in real time, or near real time, due to the data from the pressure sensors 25. In this way, the fracturing, or re-fracturing, procedure may be optimized based on pressure measurements made at the downhole location. For example, the pressure of the fracturing, or re-fracturing, fluid may be changed in real time. The pumping rate of the fluid may be changed, which results in a change in pressure within the wellbore. Likewise, the composition of the fracturing, or re-fracturing, fluid may be changed in real time based on the data from the pressure sensors. As discussed herein, fluid may be pumped down the wellbore to fracture, or re-fracture, a wellbore formation. As used herein, the generic term fluid pumped down the wellbore may include fluid pumped down an annulus between the coiled tubing and the casing, fluid pumped down the coiled tubing, and/or fluid pumped down both the annulus and the coiled tubing simultaneously.

Although this invention has been described in terms of certain preferred embodiments, other embodiments that are apparent to those of ordinary skill in the art, including embodiments that do not provide all of the features and advantages set forth herein, are also within the scope of this invention. Accordingly, the scope of the present invention is defined only by reference to the appended claims and equivalents thereof.

What is claimed is:

1. A method of fracturing a wellbore formation comprising:

positioning an end of a coiled tubing string adjacent a first location within a wellbore, the tubing string extending from a surface location to the first location;

pumping fluid down the wellbore at a pumping pressure to perform a fracturing procedure to fracture a wellbore formation adjacent the first location;

monitoring a pressure within the wellbore adjacent the first location in real time during pumping fluid down the wellbore and the fracturing of the wellbore formation with at least one sensor connected to the surface via a communication line positioned within an interior of the coiled tubing string; and modifying the fracturing procedure in real time with pumping fluid down the wellbore and fracturing the wellbore based on monitoring the pressure within the wellbore, wherein modifying the fracturing procedure in real time comprises changing the pumping pressure of the fluid being pumped down the wellbore while continuing to pump fluid down the wellbore to continue to fracture the wellbore, wherein the pumping pressure is changed at the surface and without the use of downhole flow regulators.

2. The method of claim 1, wherein changing the pressure of the fluid being pumped down the wellbore further comprises changing a pumping rate of the fluid being pumped down the wellbore.

3. The method of claim 1, wherein the fracturing procedure is a re-fracturing procedure with the wellbore formation adjacent the first location having been previously hydraulically fractured.

4. The method of claim 1, further comprising actuating an isolation element connected the coiled tubing below the first location prior to pumping fluid down the wellbore.

5. The method of claim 4, wherein monitoring the pressure further comprises monitoring the pressure in real time with a first sensor connected to an exterior of the coiled tubing string below the isolation element, monitoring the pressure in real time with a second sensor connected to the exterior of the coiled tubing string above the isolation element, and monitoring the pressure in real time with a third sensor connected to the interior of the coiled tubing string, wherein the first, second, and third sensors are connected to the communication line.

6. The method of claim 5, wherein pumping fluid down the wellbore further comprises pumping the fluid down an annulus between the exterior of the coiled tubing string and the wellbore.

7. The method of claim 5, wherein pumping fluid down the wellbore further comprises pumping the fluid down the interior of the coiled tubing string.

8. The method of claim 1, wherein pumping fluid down the wellbore further comprises pumping the fluid down the interior of the coiled tubing string and pumping the fluid down an annulus between the exterior of the coiled tubing string and the wellbore.

9. The method of claim 8, wherein monitoring the pressure further comprises monitoring in real time the pressure with a first sensor connected to an exterior of the coiled tubing string and monitoring the pressure in real time with a second sensor connected to the interior of the coiled tubing string, wherein the first and second sensors are connected to the communication line.

10. The method of claim 1, further comprising actuating a first isolation element connected the coiled tubing string below the first location and actuating a second isolation element connected to the coiled tubing string above the first location, the first and second isolation elements being actuated prior to pumping fluid down the wellbore.

11. The method of claim 10, wherein pumping fluid down the wellbore further comprises pumping the fluid down the interior of the coiled tubing string and out a port between the first and second isolation elements.

12. The method of claim 11, wherein monitoring the pressure further comprises monitoring the pressure in real time with a first sensor connected to an exterior of the coiled tubing string below the first isolation element, monitoring the pressure in real time with a second sensor connected to the exterior of the coiled tubing string between the first and second isolation elements, monitoring the pressure in real time with a third sensor connected to the exterior of the coiled tubing string above the second isolation element, and monitoring the pressure in real time with a fourth sensor connected to the interior of the coiled tubing string, wherein the first, second, third, and fourth sensors are connected to the communication line.

13. The method of claim 1, further comprising actuating an isolation element prior to pumping fluid down the wellbore, the isolation element being connected the coiled tubing string and the isolation element being positioned above the first location, and wherein pumping fluid down the wellbore further comprises pumping the fluid down the interior of the coiled tubing string.

14. The method of claim 13, wherein monitoring the pressure further comprises monitoring the pressure in real time with a first sensor connected to an exterior of the coiled tubing string below the isolation element, monitoring the pressure in real time with a second sensor connected to the exterior of the coiled tubing string above the isolation element, and monitoring the pressure in real time with a third sensor connected to the interior of the coiled tubing string, wherein the first, second, and third sensors are connected to the communication line.

15. The method of claim 1, further comprising providing diverting material within the wellbore below the first location to isolate a portion of the wellbore below the first location, wherein the diverting material is provided prior to pumping fluid down the wellbore to perform the fracturing procedure.

16. A method of fracturing a wellbore formation comprising:

positioning an end of a coiled tubing string adjacent a first location within a wellbore, the tubing string extending from a surface location to the first location;

pumping fluid down the wellbore to perform a fracturing procedure to fracture a wellbore formation adjacent the first location;

monitoring a pressure within the wellbore adjacent the first location in real time during pumping fluid down the wellbore and the fracturing of the wellbore formation with at least one sensor connected to the surface via a communication line positioned within an interior of the coiled tubing string; and modifying the fracturing procedure in real time with the fracturing procedure based on monitoring the pressure within the wellbore, wherein modifying the fracturing procedure comprises changing a composition of the fluid being pumped down the wellbore in real time.

* * * * *